US007316522B2

(12) United States Patent
Guntert, Jr. et al.

(10) Patent No.: US 7,316,522 B2
(45) Date of Patent: Jan. 8, 2008

(54) CONCRETE PLACER/SPREADER HAVING ROLL IN/ROLL OUT CONVEYOR

(75) Inventors: Ronald M. Guntert, Jr., Stockton, CA (US); Rick Francis, Stockton, CA (US)

(73) Assignee: Guntert & Zimmerman Const. Div., Inc., Ripon, CA (US)

( * ) Notice: Subject to any disclaimer, the term of this patent is extended or adjusted under 35 U.S.C. 154(b) by 167 days.

(21) Appl. No.: 11/077,991

(22) Filed: Mar. 10, 2005

(65) Prior Publication Data

US 2006/0204334 A1 Sep. 14, 2006

(51) Int. Cl.
*E01C 19/20* (2006.01)
*E01C 19/12* (2006.01)

(52) U.S. Cl. ..... 404/108; 404/101; 404/100

(58) Field of Classification Search ..... 404/100, 404/101, 90, 108
See application file for complete search history.

(56) References Cited

U.S. PATENT DOCUMENTS

| | | | | |
|---|---|---|---|---|
| 3,299,786 | A | 1/1967 | Godbersen | |
| 3,450,011 | A | 6/1969 | Godbersen | |
| 3,541,931 | A | 11/1970 | Godbersen | |
| 3,779,661 | A | 12/1973 | Godbersen | |
| 3,959,977 | A | 6/1976 | Godbersen | |
| 4,073,592 | A | 2/1978 | Godberson et al. | |
| 4,136,993 | A | 1/1979 | Fletcher | |
| 4,343,513 | A | 8/1982 | Godbersen | |
| 4,717,282 | A | 1/1988 | Anderson | |
| 4,789,266 | A * | 12/1988 | Clarke et al. | 404/96 |
| 4,930,935 | A * | 6/1990 | Quenzi et al. | 404/75 |
| 5,470,175 | A * | 11/1995 | Jensen et al. | 404/72 |
| 6,422,785 | B1 * | 7/2002 | Ruggles et al. | 404/72 |

* cited by examiner

*Primary Examiner*—Raymond W Addie
(74) *Attorney, Agent, or Firm*—Townsend and Townsend and Crew, LLP

(57) ABSTRACT

A placer/spreader for distributing already mixed concrete from an access road to a subgrade path to be paved includes a frame having at least two side bolsters standing parallel to the subgrade path and at least two cross beams spanning the subgrade path for forming a conveyor supporting structure. A roll in/roll out conveyor has a receiving end for receiving already mixed concrete from an access road and a discharge end for discharging already mixed concrete to the subgrade path, this conveyor being hinged to enable conformation to differing access road elevations. One of the two side bolsters defines forward and rear transport attachment points with a spatial interval between the transport attachment points. This spatial interval permits the roll in/roll out conveyor to be supported between forward and rear attachment points.

20 Claims, 12 Drawing Sheets

CONCRETE PLACER/SPREADER HAVING ROLL IN/ROLL OUT CONVEYOR

BACKGROUND OF THE INVENTION

This invention relates to a placer/spreader for receiving mixed concrete or base materials and distributing these materials in windrows on subgrade in the path of a slipform paver. More particularly, a placer/spreader spanning a road subgrade is provided with a roll in/roll out conveyor for receiving concrete or base material from an access road alongside the road subgrade and thereafter distributing the concrete onto the road subgrade for slipforming by a following paver. The placer/spreader includes a power unit offset from the roll in/roll out conveyor, and a beam reinforced with the conveyor track for strengthening the placer/spreader frame and supporting crawler tracks. With the roll in/roll out conveyor telescoped within and underneath the frame, the placer/spreader frame folds into a compact simplified transport configuration for shipping on a single trailer between job sites with reduced set-up time and overhead.

Slipform pavers are commonly utilized for paving reinforced and non-reinforced concrete roadways and airfield pavements. It is common practice for the concrete delivery trucks to back up on the subgrade and dump the contents of the truck on the subgrade in the path of a slipform paver and thereafter slipform the placed concrete into the final profile of the specified concrete slab section. However, in some cases it is not possible for the trucks to drive on the subgrade of the roadway in the path of the slipform paver and a separate access road must be employed alongside the road.

The placer/spreader here disclosed has utility where an access road is required. Access roads are required along the road subgrade when the subgrade in front of the slipform paver is not suitable for driving and dumping (such as when the subgrade is extremely porous, for example where superior drainage under the placed pavement is desired) or is too soft, thus not being supportive enough for the delivery trucks. It also has utility to receive and distribute concrete over the top of pre-placed dowel basket assemblies or continuous reinforcing bar reinforcement secured to the subgrade that would otherwise block the path of the concrete delivery trucks.

Placer/spreaders of the prior art typically utilize a side delivery conveyor for receiving from concrete delivery trucks traveling along the access road (alongside the road subgrade) and then distributing freshly mixed concrete in front of the slipform paver on the subgrade to be paved. These side receiving conveyors are of two types: hinged conveyors and so-called "roll in/roll out" conveyors.

Hinged conveyors extend to the side of the placer/spreader at the access road for receiving already mixed concrete from a delivery truck and transporting and distributing that concrete onto the subgrade in the path of the slipform paver. Such hinged conveyors are relatively inexpensive and well understood in their operation. Such hinged conveyors do have disadvantages and advantages over roll in/roll out conveyors.

First, hinged conveyors typically hinge down onto and up out of an access roadway at the side of the road surface to be paved each time a delivery truck must pass. There is frequently insufficient room on the access road for trucks to drive around the hinged conveyor when it is in the down position. The access road is only wide enough for one truck to pass. Before a hinging up movement can occur, the conveyors have to be emptied of concrete. Only when the conveyors are emptied of concrete can hinging occur. Thus a precisely timed sequence of truck dumping and conveyor loading, belt emptying, and finally belt hinging up (to allow the next truck to pass) and coordinated delivery truck movement must occur. This precise coordinated movement is not always possible at construction sites, especially where soft road conditions make movement of both the placer/spreader and delivery trucks unpredictable.

Where precise delivery truck and/or placer/spreader movement does not occur, collisions between the receiving end of the conveyor and delivery truck frequently occur. This often results in structural damage to the conveyor, intermittent concrete delivery, and ultimately less than optimum slipform paver movement. Conveyor damage can be catastrophic, bringing the entire road building process to a halt. Further, these collisions, intermittent delivery, and intermittent paver movement can cause uneven pavement surfaces with resultant contract penalties for placement of other than level (smooth) pavement surfaces. Since modern road construction contracts provide premium or bonus payment for smooth roadways and deduction from full payment for uneven pavement surfaces, smooth/level pavement surfaces can significantly impact the road contractor financial results on the project.

Furthermore, the time lost in running the conveyor empty prior to hinging up the conveyor reduces the productive ability of the placer/spreader by reducing the number of loads per hour that the placer/spreader can handle. This reduced productivity may require the use of a second placer/spreader in order to absorb the full output of a high production concrete plant.

Many times access road elevations can vary widely when the access road surface is soft. This can cause problems when the receiving end of the conveyor is too high for the truck to dump into. This leads to delay in the dumping of the truck and adversely affects production.

It is known in the prior art that one advantage of hinged conveying is that the angle of the receiving end of the conveyor can be varied hydraulically on the fly to match the slope or uneven elevation of the access road. The disadvantage of the prior art roll in/roll out conveyor is that it had no ability to adjust the angle of the receiving belt to match the slope or uneven elevation of the access road on the fly. The inability of the conveyor to adjust easily for varying access road slopes and elevations also contributes to lost production.

Roll in/roll out conveyors of the prior art have a concrete receiving end and a slightly elevated concrete discharge end. The concrete receiving end typically telescopes out and is supported in a cantilever fashion overlying the access road. This requires the access road to be well-graded, compacted and level. Already mixed concrete is unloaded onto the cantilevered concrete receiving end of the conveyor. The roll in/roll out conveyor then undertakes two discrete movements.

A first movement is the conventional operation of the conveyor transporting the received concrete from the receiving end of the conveyor to the discharge end of the conveyor. Dependent upon the location of the discharge end of the conveyor, concrete is distributed onto the subgrade to be paved.

A second movement is the so-called telescoping movement of the conveyor. Typically, while the conveyor is running in conventional conveying movement (with concrete still on the belt), the entire conveyor telescopes relative to a supporting U-frame so that its discharge end traverses the subgrade to be paved (e.g. "roll-in"). In such traversing of the subgrade, concrete is still being unloaded off the belt and distributed as the discharge end traverses the subgrades to be paved. As much as a third of a truckload of concrete can still be present on the running belt when the belt is being rolled in.

Additionally, and as a consequence of the second movement, the discharge end of the conveyor distributes the remaining concrete on the belt across the subgrade during its traversing movement. Prior to the transverse movement of the conveyor, concrete can accumulate in the traversing path of the telescoping conveyor overlying the subgrade. The conveyor discharge end when equipped with a strike-off plate can collide with and strike off the upper portion of the accumulated concrete pile, further distributing concrete on the subgrade to be placed. This allows the entire truckload of concrete to be discharged without delay.

In contrast to this, a hinge-up conveyor configuration must receive the entire truckload of concrete before the placer/spreader can move ahead. With large truckloads of concrete, many times the concrete pile under the discharge end of the conveyor gets so high that it prevents remaining concrete on the conveyor from being discharged. The concrete backs up on the conveyor. The only way to resolve this situation is to move the placer/spreader and dumping truck ahead to make room under the discharge end of the conveyor so the conveyor can empty. Only when the conveyor is empty can the conveyor receiving end hinge up to allow the next delivery truck to pass.

Because of these distribution characteristics, roll in/roll out conveyors have superior concrete distribution characteristics over hinged conveyors and are more productive. Furthermore because of the inherent weakness of a hinge conveyor to side loads (namely a truck colliding with it) the roll in/roll out conveyor configuration is superior and more robust in construction. Because the hinged conveyor must be able to hinge more than 90 degrees, it is almost impossible to build a hinge with sufficient strength and structural integrity to prevent damage when a truck hits it. The more robust construction possible with a receiving end of a roll in/roll out conveyor makes it capable of colliding with and even pushing delivery trucks, which hinged conveyors cannot. This is important from a standpoint of minimizing potential down time and increasing the productivity of roll in/roll out and hinged conveyors.

Prior art roll in/roll out conveyors are typically supported on a separate support frame (conveyor module). This modular support frame includes paired bolsters aligned parallel to and arranged on either side of the subgrade to be paved. Paired crossbeams span the subgrade between the bolsters and tie the two bolsters together. The conveyor and its overlying support frame (as a module) are inserted between bolster-supported jacking columns with supporting crawler tracks in front of and a traditional paver-like tractor with a power plant behind the conveyor module. The diesel/hydraulic power unit is centered and on top of the tractor frame and provides power for the entire placer/spreader, including the roll in/roll out conveyor. The tractor unit also includes a removable set of rear jacking columns and supporting crawler tracks.

Unfortunately, roll in/roll out conveyors as presently used and implemented on such support frames and tractor frames with power units have several disadvantages.

First, such roll in/roll out conveyors and their supporting structures require heavy-duty construction. When loaded with already mixed concrete their weight increases considerably. Typically, when the conveyor is rolled, it can be holding up to four yards of concrete weighing approximately 3000 pounds each. Thus the supported roll in/roll out conveyors are a heavy dynamic load, placing high load demands on their supporting frames.

These heavy roll in/roll out conveyors are typically provided with two support points. A first support point is adjacent the access road. This support point adjacent the access road enables the extended conveyor to cantilever out into the access road for receiving ready-mix concrete. The second support point is on a rail spanning the width of the subgrade over the roll in/roll out conveyor. When the conveyor telescopes in, severe loading is placed on the support frame through the second support points on the spanning rail. From the spanning rail, the loading is distributed to the placer/spreader frame.

Second, such placer/spreader frames are utilized to support a hydraulic power plant for powering the entire placer/spreader including the roll in/roll out conveyor. Adding the weight of the roll in/roll out conveyor to the same frame supporting the power plant has thus far necessitated the use of two frames. Specifically, the tractor frame is utilized to support a ground-level concrete spreader (such as an auger spreader) and the hydraulic power unit. A second dedicated conveyor supporting frame is utilized for the support of the loaded telescoping roll in/roll out conveyor.

In the mid-1960s, CMI Corporation (originally Construction Machinery Inc.) of Oklahoma City, Okla., manufactured a placer/spreader known as the PST 400 having the above construction with a roll in/roll out conveyor belt. Since then, another manufacturer copied this machine in its entirety. The machine included a main tractor frame with two side bolsters supporting an underlying concrete spreader auger with strike-off and an attached overlying power unit. The main tractor frame had an attaching rear bolster. Attached to the front of the main tractor frame was a conveyor supporting frame (conveyor module) which had an underlying roll in/roll out conveyor and an attaching front bolster. The entire assembly was supported on four jacking columns with crawler tracks.

This machine had superior function and productivity but was bulky, requiring multiple loads to be transported between job sites.

Specifically, three discrete loads must be transported. Further, both assembly and disassembly of the unit require a crane assist. Regarding the loads, a first load includes the main tractor frame with the power unit and an underlying spreader auger assembly. A second load includes the conveyor supporting frame with an underlying roll in/roll out conveyor. A third and final load includes the disassembled front and rear bolsters, each with jacking column and supporting crawler track. Disassembly and assembly of the placer/spreader was and is very time-consuming and takes days to set up and tear down.

Moreover, the two discrete frames, namely the conveyor support frame and the tractor frame, require re-sectionalization when a width change of the placer spreader is required, say to change the width from a standard 24-foot wide pavement to a 30-foot wide pavement.

It should be understood that spreader augers utilized by the prior art are less than optimum. Typically, and because of the limits of the auger flighting and the mass of the auger, a central support bearing is required to support the auger from the main tractor frame. The supported auger includes opposed auger flights terminating at a central bearing. Further, such augers have a diameter in the range of three feet in order to be large enough to spread concrete rapidly. Finally, and assuming that more concrete is placed on one side of the auger support bearing than on the other side of the auger support bearing, redistributing concrete across the central support bearing of the spreader auger is problematic at best. Spreader augers are very costly to operate because the auger flighting and the bearings wear out rapidly when conveying abrasive concrete.

During the inventors' research and work that led to the development of the following described placer/spreader, considerable resistance was encountered from our prospective customers to the use of roll in/roll out conveyor belts. This resistance was a direct result of the extraordinarily difficult and time-consuming set-up, transport and width change costs of prior art machines utilizing roll in/roll out conveyors. Interestingly enough, even though customers do not like the prior art placer/spreader, they often refer to the advantages of roll in/roll out conveyors. Specifically, we realized after our research that a placer/spreader utilizing a roll in/roll out conveyor (that had some limited ability to adjust the angle of the receiving end of the belt to compensate for sloped or uneven access roads) and that could be transported in a single load would have great utility and value to users.

The reader will realize that the above close analysis of failings of the prior art has been our work product, resulting from considerable research. It will be further understood that we have never seen the comments set forth above serially in the prior art together with the problems generated by such prior art. It is well known that the recognition of problems to be solved can constitute invention. Accordingly, we claim invention in recognizing the problems to be solved as well as setting forth the particular solutions to those problems.

SUMMARY OF THE INVENTION

A placer/spreader for distributing already mixed concrete from an access road to a subgrade path to be paved includes a frame having at least two side bolsters standing parallel to the subgrade path and at least two cross beams spanning the subgrade path for forming a conveyor supporting structure. A roll in/roll out conveyor has a receiving end for receiving already mixed concrete from an access road and a discharge end for discharging already mixed concrete onto the subgrade path. The conveyor is hinged to conform it to differing access road elevations. One of the two side bolsters defines forward and rear transport attachment points with a spatial interval between the transport attachment points. This spatial interval permits the roll in/roll out conveyor to be supported between forward and rear attachment points. The other of the two side bolsters defines an attachment point for at least one transport. At least three transports are attached at the two side bolsters with the at least two transports attached to the forward and rear transport attachment points and the at least one transport attached to the other of the two side bolsters.

A support mounted within the spatial interval between the transport attachment points provides for the cantilevered telescoping support of the roll in/roll out conveyor during telescoping movement adjacent the access road. A support rail for the traversing support of the discharge end of the roll in/roll out conveyor is included below the frame to reinforce the frame against bending as well as to provide a support for the traversing conveyor. A support attached at the discharge end of the roll in/roll out conveyor moves along the support rail for the traversing support of the discharge end of the roll in/roll out conveyor. There are further means for moving the roll in/roll out conveyor in telescoping movement relative to the frame whereby the receiving end of the roll in/roll out conveyor is telescoped from and extends from the cantilevered support into the access road to receive already mixed concrete. Thus, the discharge end of the roll in/roll out conveyor discharges and/or distributes already mixed concrete across the subgrade path during the telescoping movement.

DESCRIPTION OF PREFERRED EMBODIMENTS OF THE INVENTION

Figure 1A:
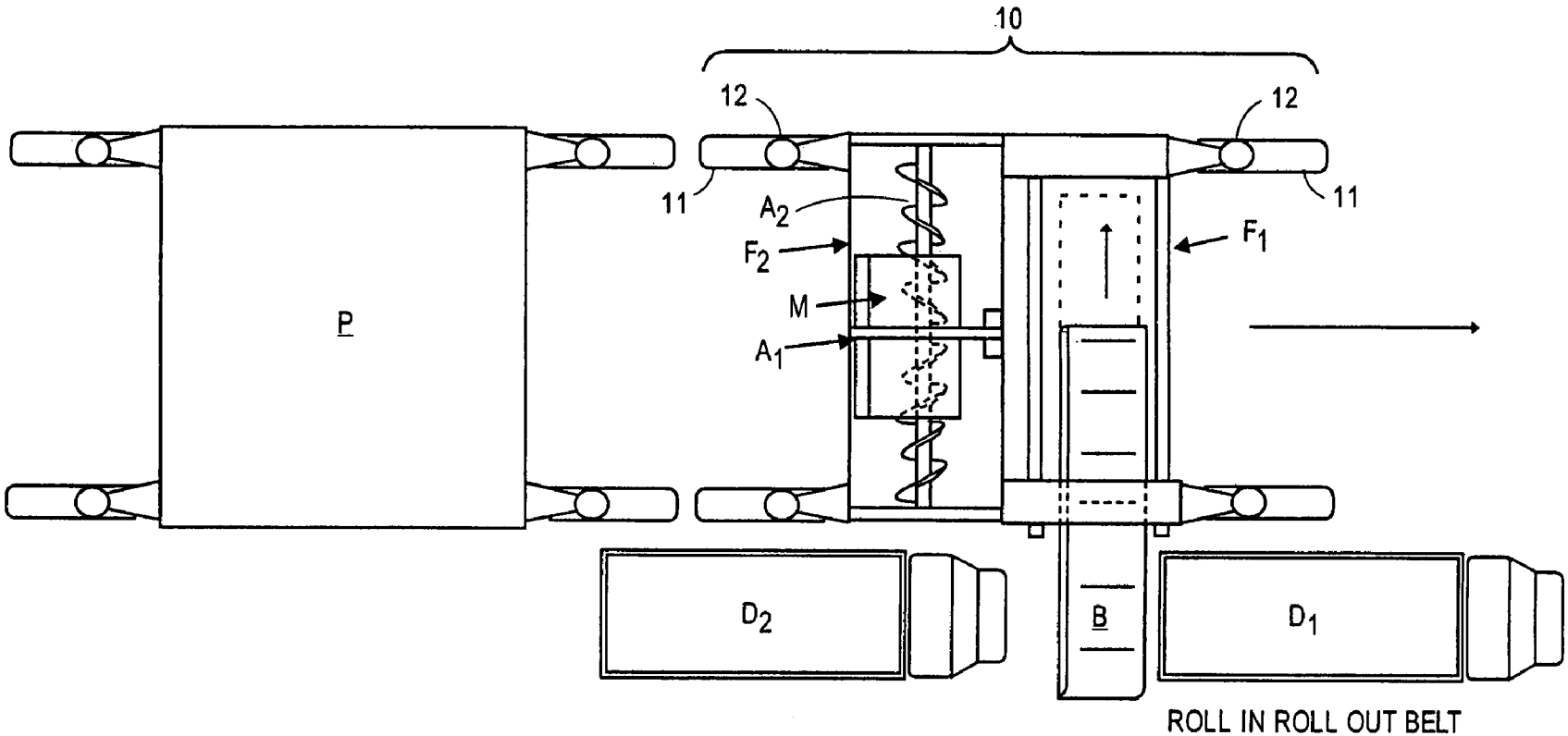
FIG. 1A (PRIOR ART)
FIG. 1A is a view of a prior art placer/spreader of the roll in/roll out variety illustrating the placement of concrete from an access roadway to a subgrade for the placement of a roadway or airfield pavement.

Referring to FIG. 1A, the apparatus of the closest prior art is illustrated deployed for paving. Placer/spreader 10 is illustrated with frame F1 containing a telescoping conveyor belt B. Frame F2 supports machinery module M, opposed augers A1 and A2, and a central auger bearing R. As has been emphasized, the opposed augers are heavy, have relatively high power requirements for operation, and have difficulty in spreading concrete across their bearing R. The illustrated placer/spreader 10 is followed by a paver P for the forming of the placed concrete. Four crawlers 11 with attached columns 12 propel placer/spreader 10.

In operational order, the belt places the concrete, the augers spread the concrete, and finally paver P forms the concrete into the road profile. Thus the progress of the placer/spreader 10 is from the left to the right of FIG. 1A.

Concrete is typically mixed at a batch plant (not shown) and transported in dump trucks D1 and D2. In the view here shown, truck D1 is shown after having delivered a load of concrete; truck D2 is shown ready to position itself after the roll in/roll out conveyer has telescoped inward.

Figure 1B:
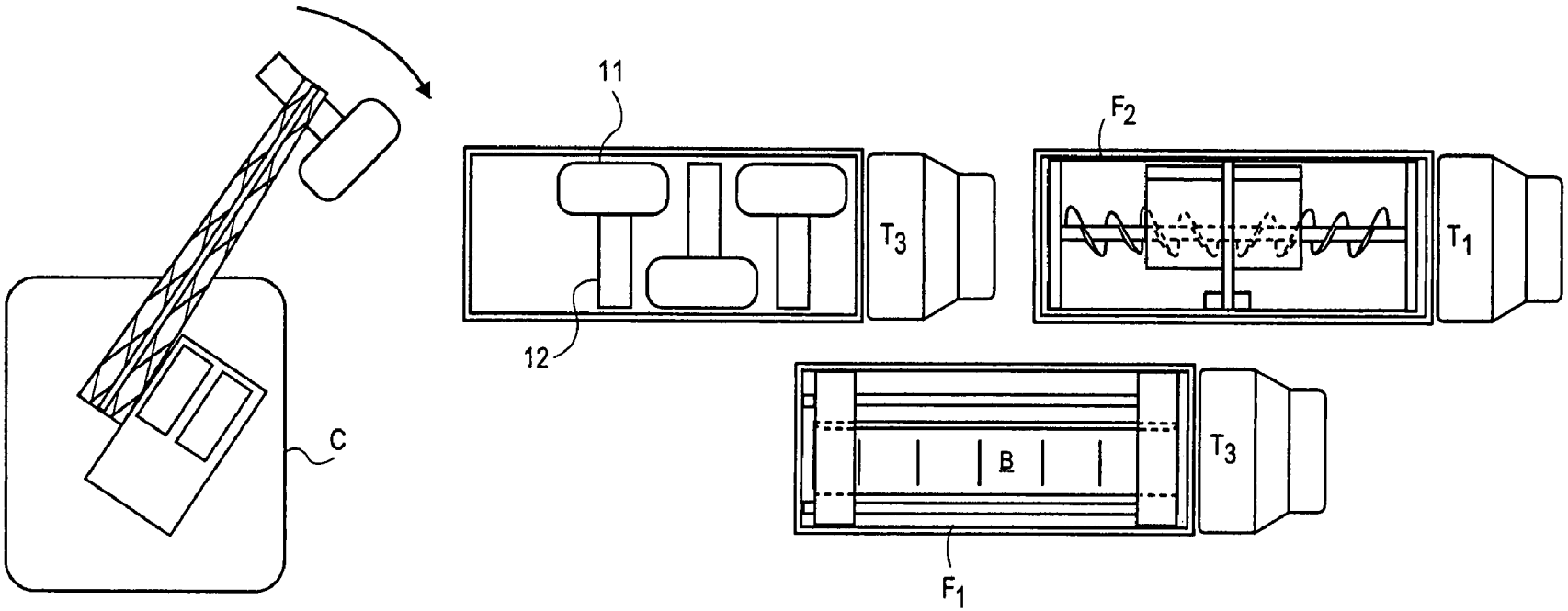
FIG. 1B (PRIOR ART)
FIG. 1B is a view of the prior art placer/spreader of FIG. 1A with the placer/spreader dismantled for transport between job sites, here illustrating the necessity for movement in three discrete loaded segments with the crane required for such dismantling shown adjacent the loaded bolsters.

Referring to FIG. 1B, the apparatus of the closest prior art is illustrated being transported between job sites. Frame F2 is on flatbed truck T1 and frame F1 on flatbed truck T2 with crane C shown placing the final crawler 11 and jacking column 12 on flatbed truck T3. While the schematic of FIG. 1B would make such disassembly appear trivial, the actual practice is quite different; much time and effort is required for the disassembly and assembly. This will be understood by reference to the drawing figures of this application, which have been reproduced from actual construction drawings for the equipment. Accordingly, it is a main purpose of the present disclosure to simplify this process of transport between job sites.

Figure 2:
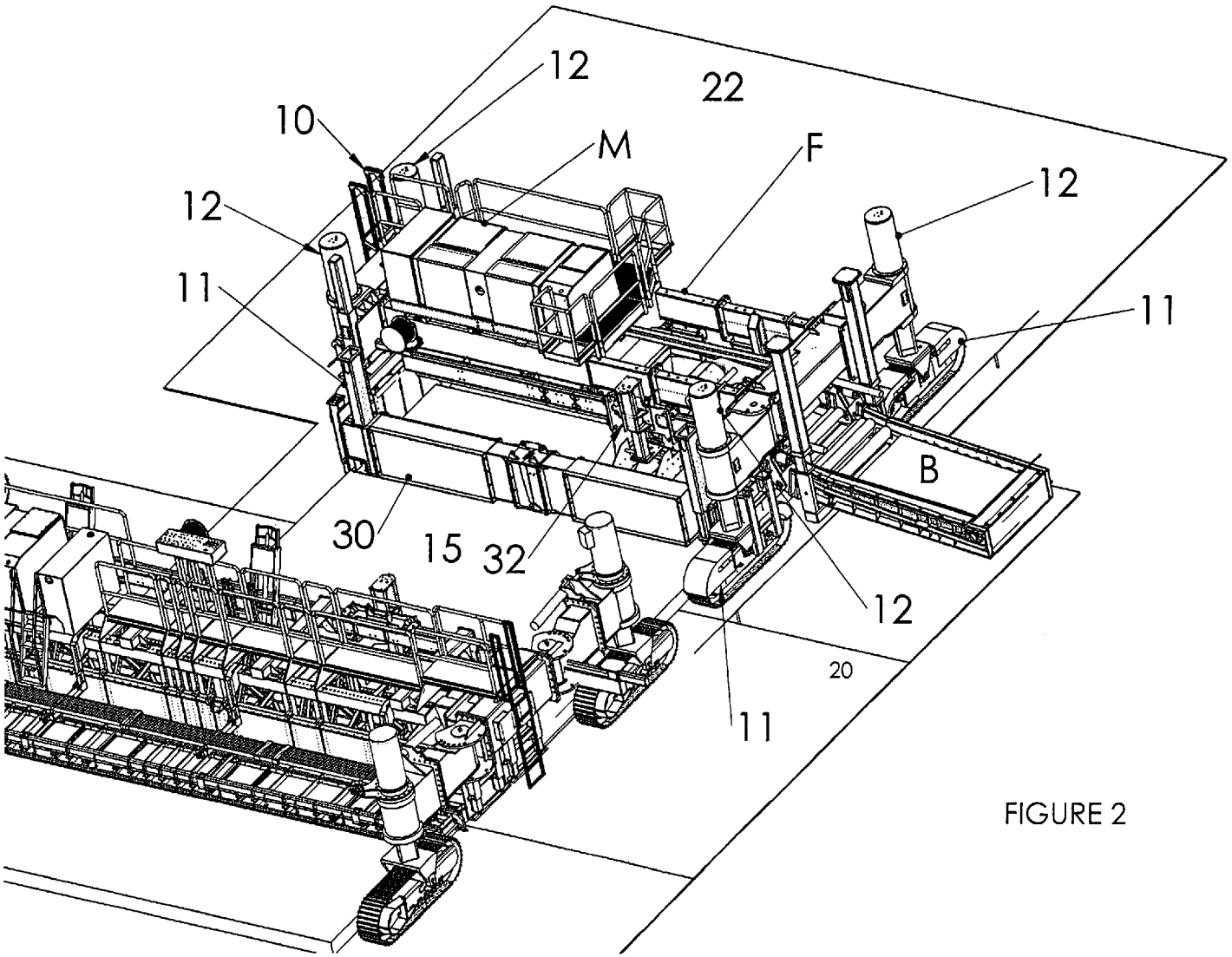
FIG. 2 is a perspective view of a roadway and/or airfield pavement under construction showing a subgrade path traversed by the placer/spreader of this invention with a roll in/roll out conveyor extending across a nearby access road bounding the subgrade path and a slipform paver partially shown slipforming already mixed concrete placed in windrows and spreading by the placer/spreader in front of the advancing paver.

Referring to FIG. 2, placer/spreader 10 is shown supported on and propelled by two crawlers 11 and two jacking columns 12 adjacent access road 20 and one crawler 11 (not shown) and two jacking columns 12 on the opposite side. Placer/spreader 10 proceeds in direction 22 placing and spreading concrete while slipform paver P follows, slipforming the placed concrete 15 into the profile of the desired road or runway 16.

Concrete is received on belt B when the belt is telescoped out from under frame F. The concrete, once received on belt B, is conveyed by the belt to the discharge end of the belt within frame F. As belt B telescopes into the frame, the discharge end of the belt moves across the paving path from the side adjacent access road 20 to the side away from the access road 20. This moves the discharge end of the belt B and causes further distribution of the concrete. Considerable power is required for this movement. Accordingly, hydraulic cylinders with accumulators are preferably used.

Even this placement of the concrete is not perfect. Accordingly, a spreader plow 32 riding on frame F is placed between a strike-off bar 30 and frame F. Side-to-side movements of spreader plow 30 distribute concrete evenly into the advancing path of paver P. Strike-off bar 30 also trims concrete to the desired profile at placed concrete 15 for slipforming by paver P. Spreader plow 32 and strike-off bar 30 assure essentially an even distribution of concrete 15 by trailing belt B. Spreader plow 32 is powered by a hydraulically operated reel and cable unit; powering by a double-acting hydraulic cylinder can be employed instead. Spreader plow 32 typically operates from a rail 31 which permits side-to-side movement.

Power for the unit is required, the preferred unit here shown being a hydraulic actuator. Accordingly, machinery module M is placed eccentrically on frame F away from access road 20 toward single crawler 11 with its paired jacking columns 12. This placement is cooperative with the underlying railway for supporting the telescoping belt B, especially when the width of the placer/spreader 10 is expanded.

Figure 3A:
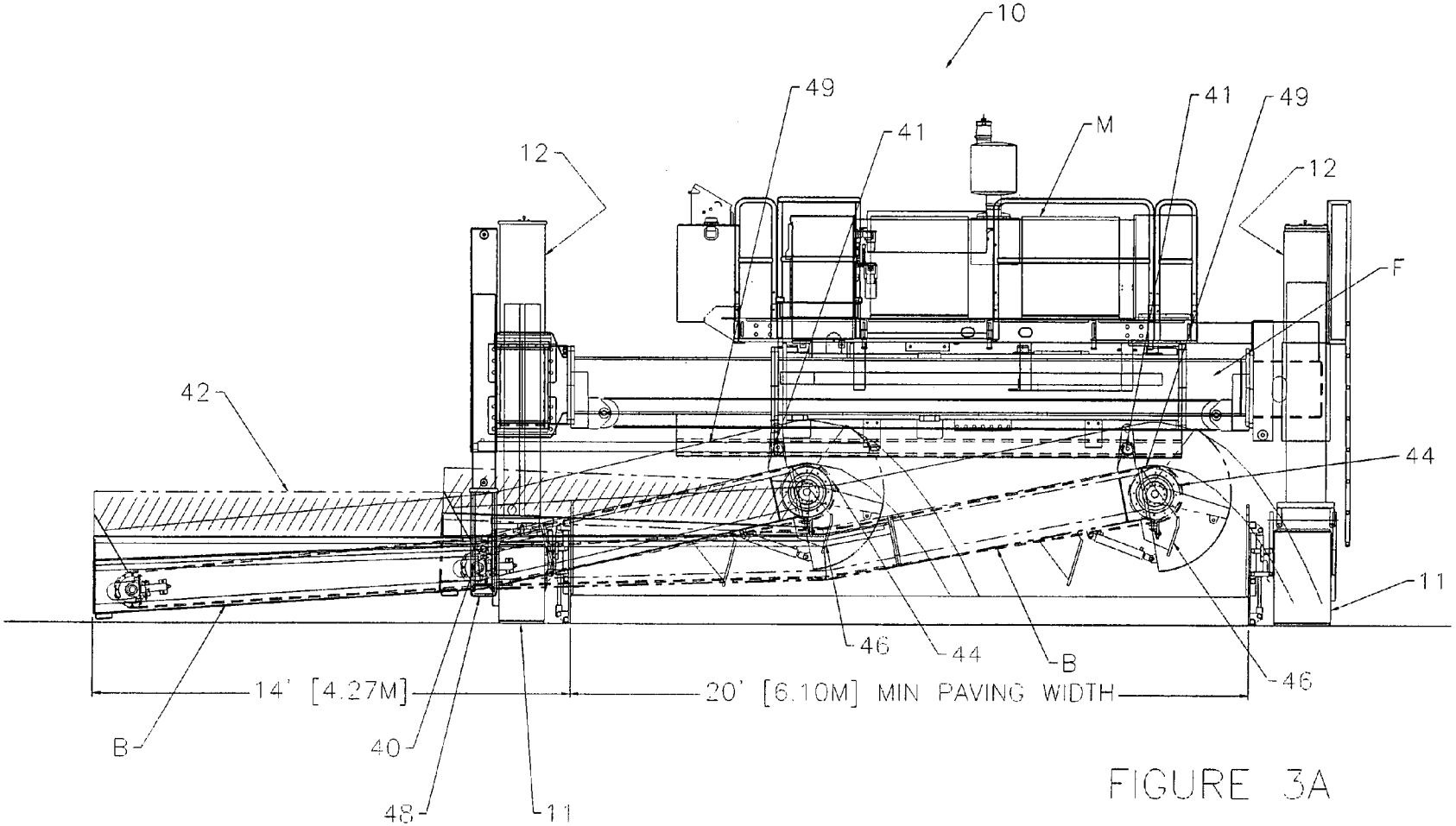
FIG. 3A is a view of the placer/spreader spanning a minimum paving width illustrating movement of the roll in/roll out conveyor.

Referring to FIG. 3A, placer/spreader is shown configured for a minimum 20-foot width. Several important features should be noted.

First, telescoping belt B can be seen in side elevation in two dispositions. A first disposition has loading end 42 over the access road with discharge end 44 located approximately medially of frame F. Belt B is also shown telescoped into frame F with discharge end 44 remote from access road 20. Belt B telescopes horizontally between the two positions, discharging concrete during the telescoping movement.

Second, belt B has a belt strike-off plate 46. As belt B moves in telescoping movement relative to frame F, the strike-off plate itself serves to spread concrete when concrete accumulates to the level of the strike-off plate.

Third, belt B is supported adjacent access road 20 by a cantilever support 48. Further, belt B is supported within frame F by rails 49. Rails 49 allow belt support 41 to traverse the underside of frame F. Rails 49 stiffen the section of frame F as it supports machinery module M.

Fourth, belt B includes a medial hinge 40. Hinge 40 flexes belt B through an angle not exceeding 15 degrees. This point of hinging allows belt B to accommodate access roads 20 of varying elevation relative to the path of placer/spreader 10.

Figure 3B:
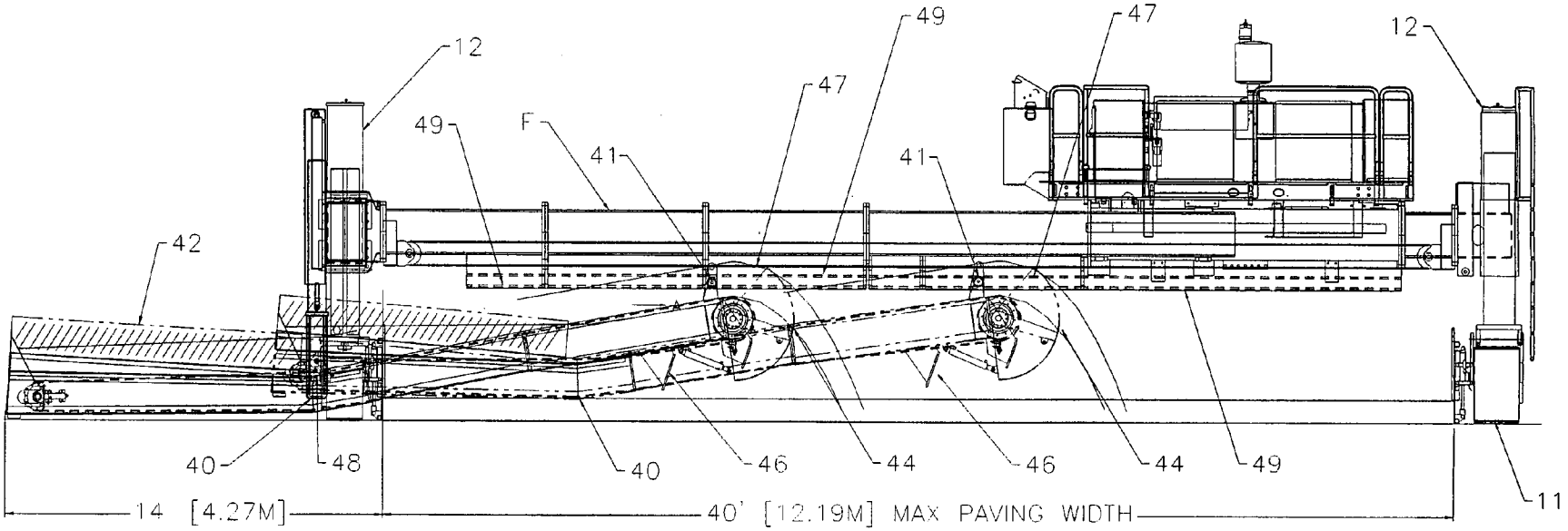
FIG. 3B is a view of the placer/spreader spanning a maximum paving width illustrating movement of the roll in/roll out conveyor.

Referring to FIG. 3B, frame F is shown expanded to maximum 40-foot width. Along with the expansion of frame F, rails 49 are likewise expanded. Thus the traverse of discharge end 44 with its strike-off plate 46 is expanded. Further, the section of frame F reinforced by rails 49 is also increased. It is this duality of the section of frame F reinforced by the section of rails 49 that allows the expanded unit to support machinery module M and undertake the dynamic loading caused by the telescoping movement of belt B. In the expanded disposition, all functions illustrated remain the same. The expansion is accomplished by the insertion of frame and rail segments 47. The configuration of these segments as actually used is illustrated in the drawings; this configuration can be varied as necessity requires.

Figure 4:
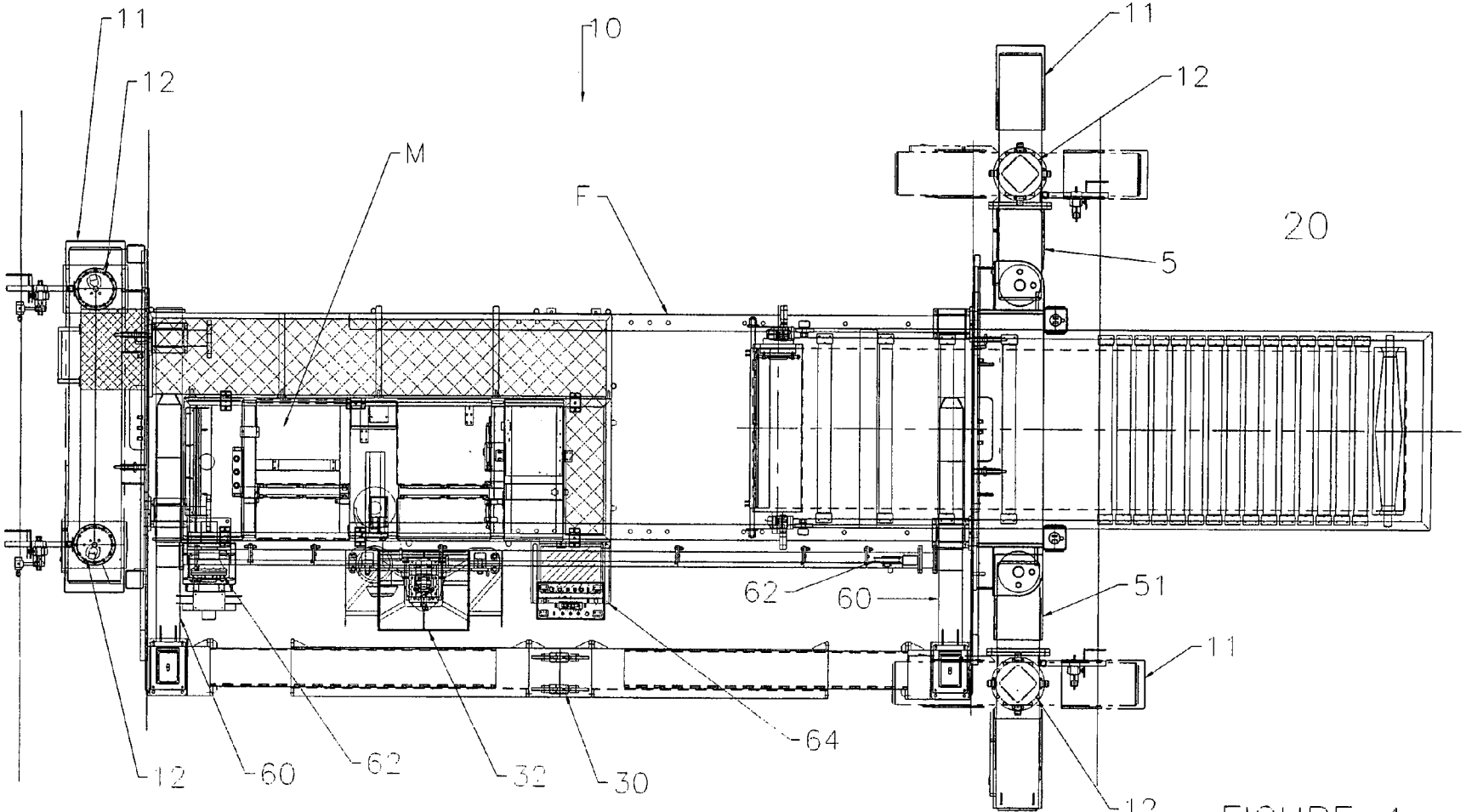
FIG. 4 is a top plan view of the placer/spreader shown with a strike-off bar and spreader plow attachment disposed in configuration for placing and spreading the already mixed concrete along a subgrade path to be paved.

FIG. 4 is a plan view of placer/spreader 10. Frame F has crawlers 11 and jacking columns 12 supporting frame F. Here, and distant from access road 20, a single crawler 11 having two supporting jacking columns 12 is utilized. Adjacent access road 20, paired crawlers 11 each with its own attached jacking column 12 are utilized. As will hereafter be emphasized with reference to FIG. 5, the respective crawlers 11 and jacking columns 12 are attached to frame F with pivotal arms 51. The pivotal arms allow convenient folding of crawlers 11 to a position adjacent frame F when transport of the placer/spreader between job sites occurs.

Strike-off bar 30 is supported from frame F by attachment probes 60. Additionally, spreader plow 32 traverses frame F on a cable and rail system 62. It should be noted that any system that enables spreader plow 32 to traverse frame F can be used; for example, instead of cable and rail system 62, a hydraulic system can be used.

It is important to provide the operator with a platform having a vantage point over the operation. Accordingly, a fold-down platform 64 provides for operator support over telescoping belt B, spreader plow 32 and strike-off beam 30.

The two crawlers adjacent access road 20 supported on pivotal arms 51 have rotation relative to the pivotal arms 51. This not only permits steering of placer/spreader 10, but in addition is critical in assuring a compact disposition of the placer/spreader when it is shipped between job sites.

Figure 5:
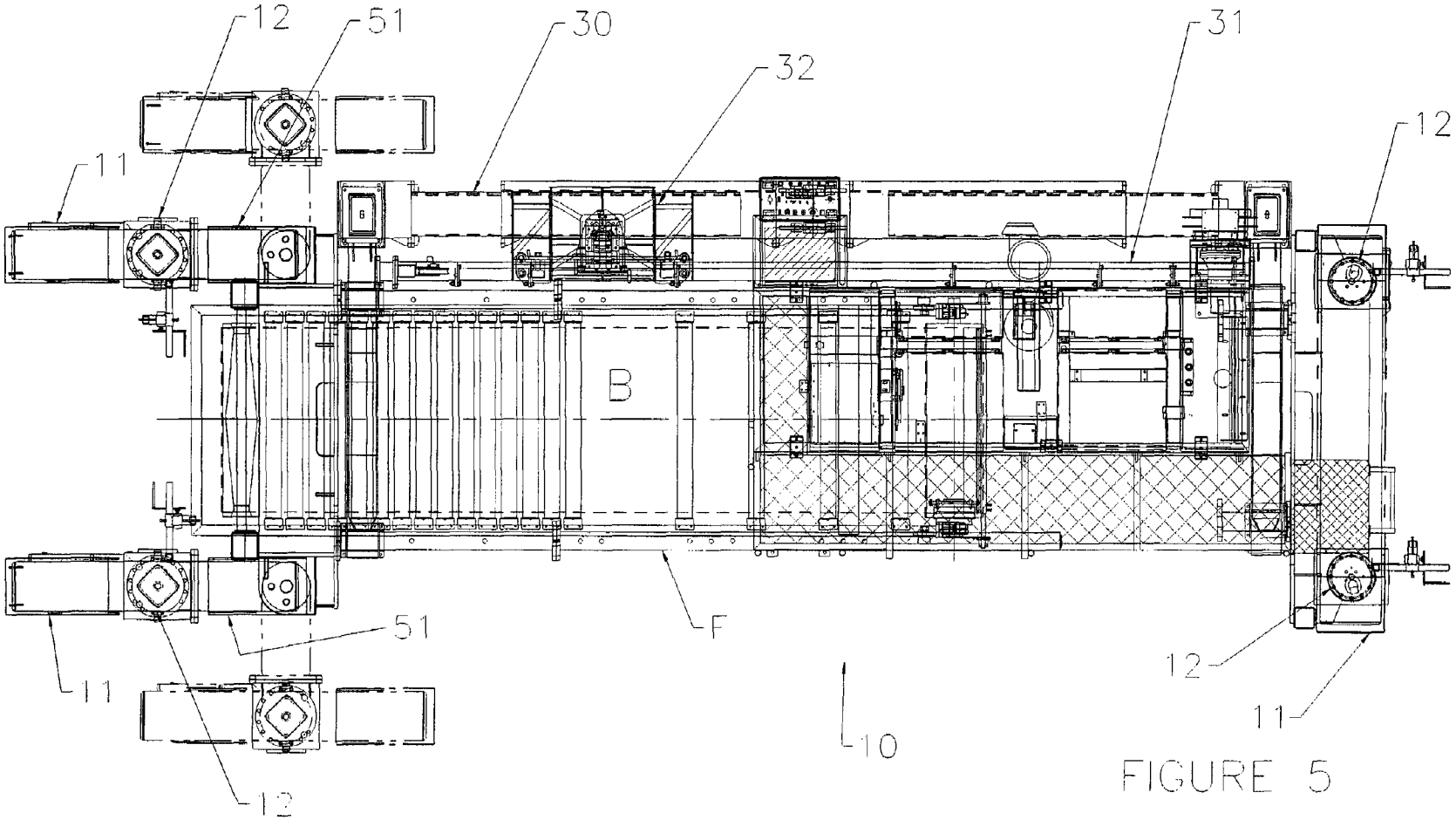
FIG. 5 is a top plan view of the placer/spreader shown in FIG. 3A supported on an underlying trailer with crawler tracks pivoted to enable loading/hauling and retraction of the roll in/roll out conveyor into and underneath the main tractor frame.

Referring to FIG. 5, placer/spreader 10 is shown configured for transport between job sites. First, crawlers 11 and jacking columns 12 have been pivoted on arms 51 to be adjacent the sides of frame F, as is shown in phantom lines. In this disposition, the entire assembly is slightly over 8 feet in width and easily fits on a 40-foot long single flatbed truck.

Further, jacking columns 12 can raise frame F to an elevation where a flatbed truck is easily backed under the elevated frame F.

Once frame F is supported on a flatbed truck, jacking columns 12 can be raised from ground support to support from the bed of the truck.

Further, spreader plow 32 is pivoted upward. At the same time, strike-off bar 30 is drawn into close juxtaposition relative to frame F. The entire placer/spreader 10 can be hauled on a single trailer.

Figure 6A:
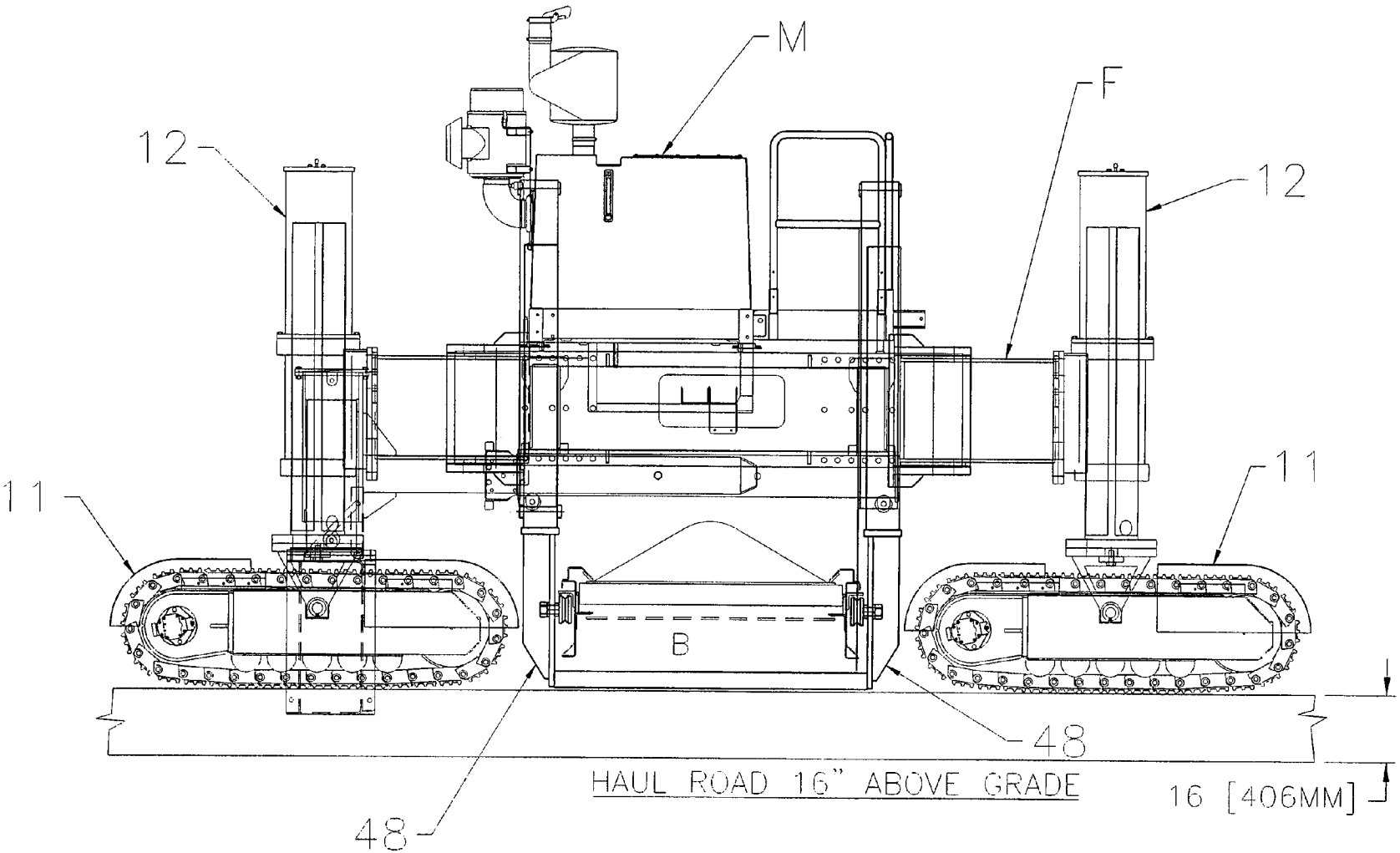
FIGS. 6A, 6B and 6C are side elevation sections of the placer/spreader taken at the access road illustrating the cantilevered support of the roll in/roll out conveyor where the access road changes with respect to grade, illustrating the placement of a hinge on the roll in/roll out conveyor and its adjustment to receive concrete; and, FIGS. 7A and 7B are a series taken at the cross beams illustrating expansion of the cross beams by both the insertion of a combination rail segment and a conventional bolt in beam segments, with the view of FIG. 7A illustrating a straight beam and the view of FIG. 7B illustrating a beam having an adjustable profile for the placement of a beam in the placed concrete.

FIG. 6A shows a side elevation of placer/spreader 10 and is taken from access road 20. Crawlers 11 and their respective jacking columns 11 are shown with reciprocating belt B supported at cantilever support 48. The height of cantilever support 48 can be varied to produce correspondingly varied support of belt B.

Figure 6B:
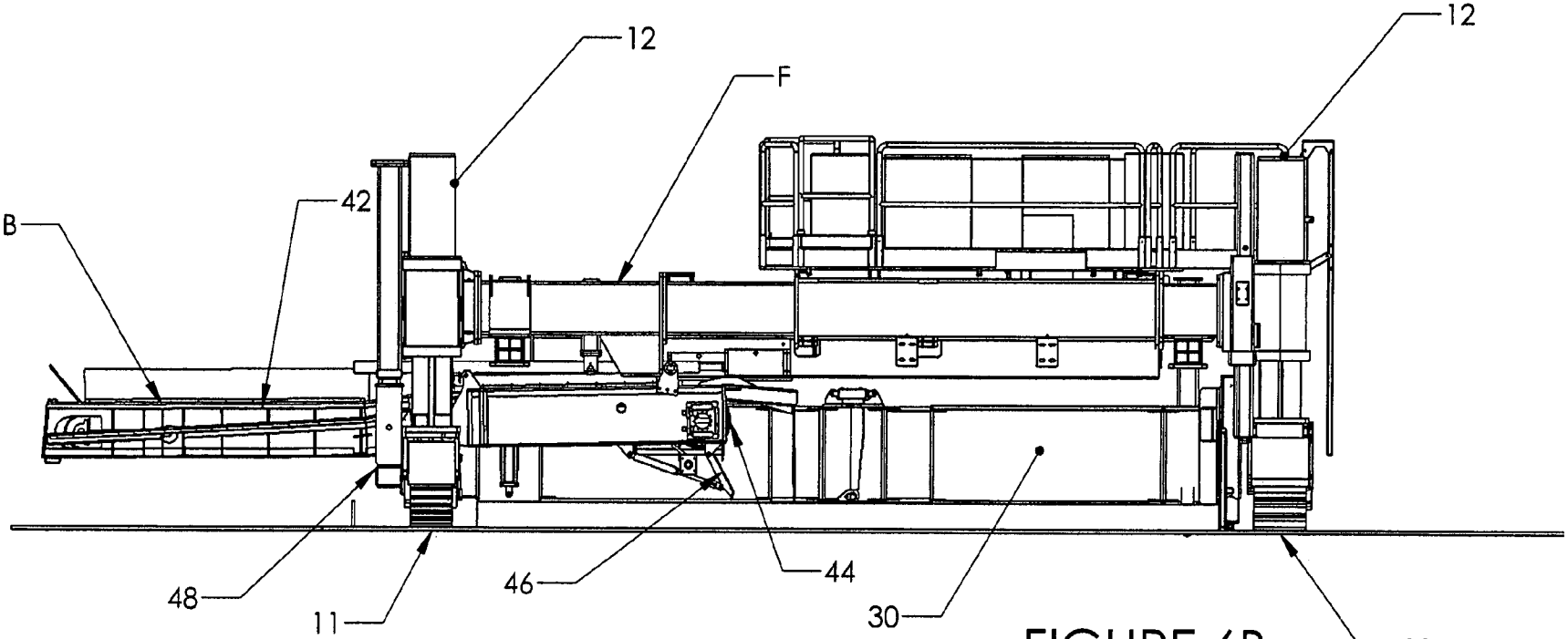
Figure 6C:
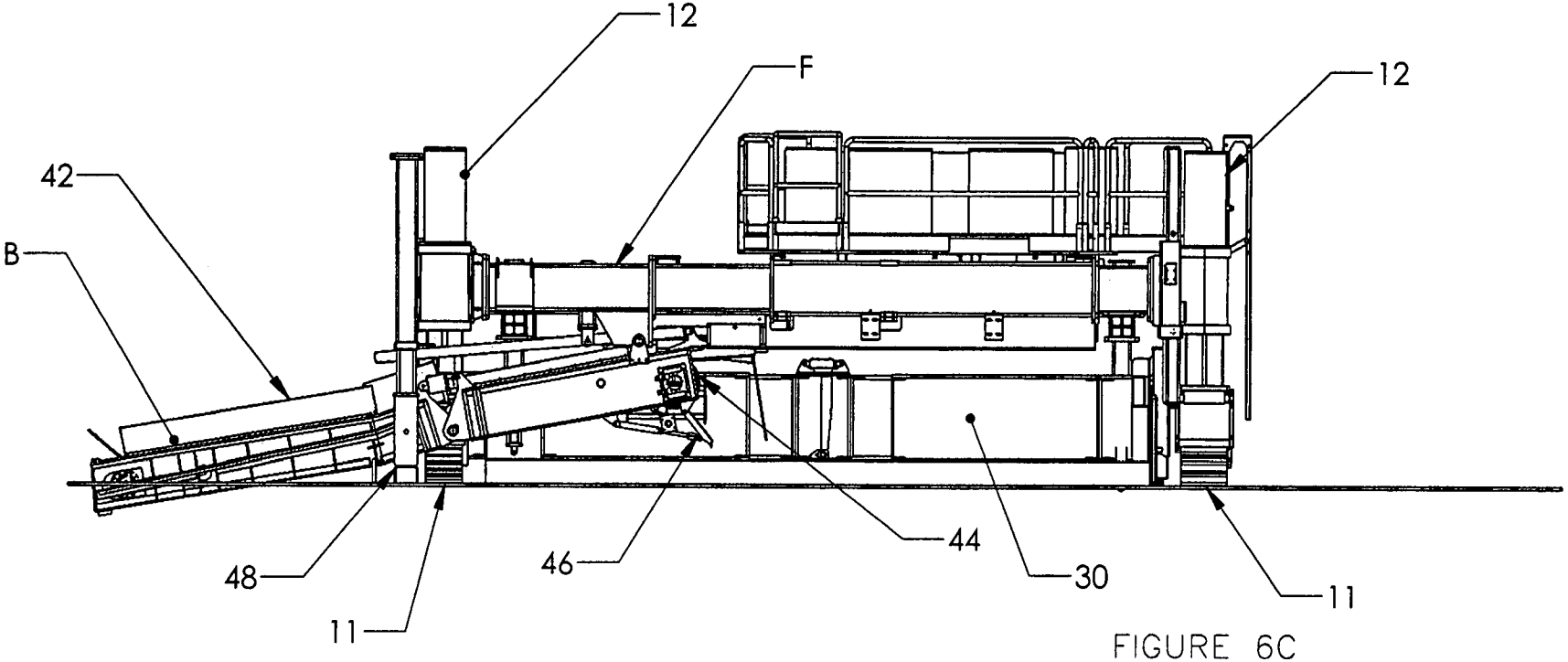

FIG. 6B shows belt B elevated for receiving concrete from an access road having an elevation above the surface upon which concrete is placed by the placer/spreader 10. Similarly, FIG. 6C shows belt B for receiving concrete from an access road having an elevation below the surface onto which concrete is placed.

Figure 7A:
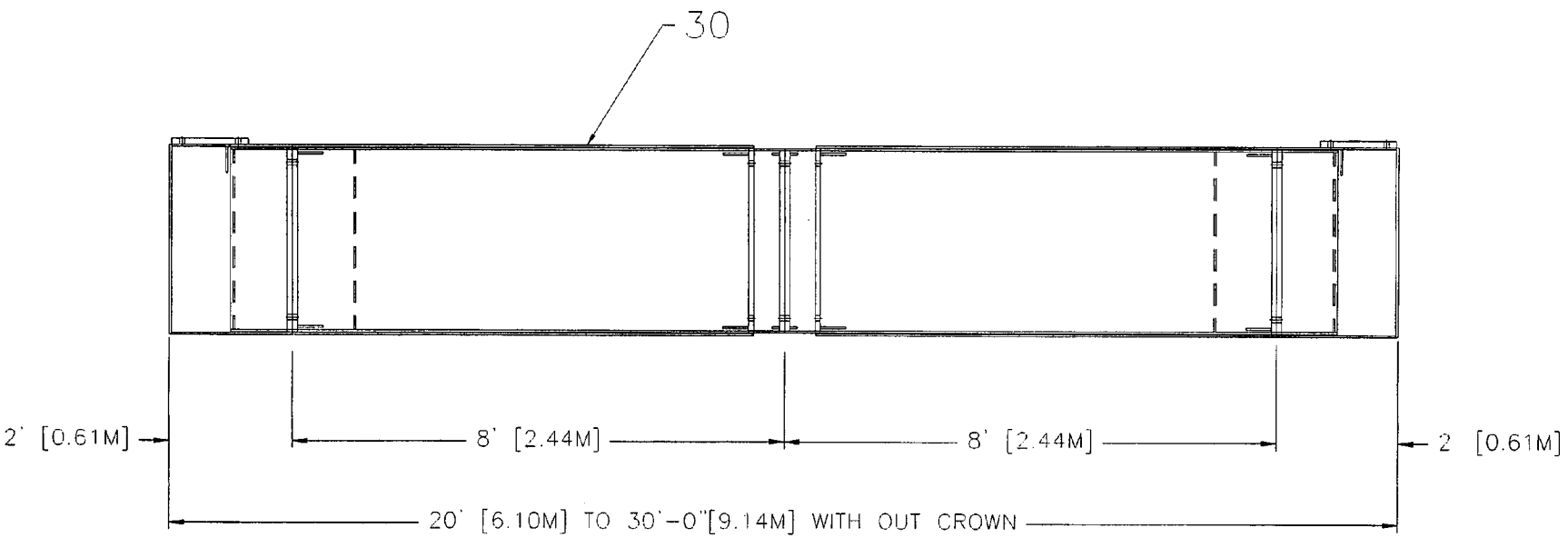

FIG. 7A shows strike-off beam 30 in its narrowest configuration when it is 20 feet wide and comprises a solid straight beam extending across the pavement path.

Figure 7B:
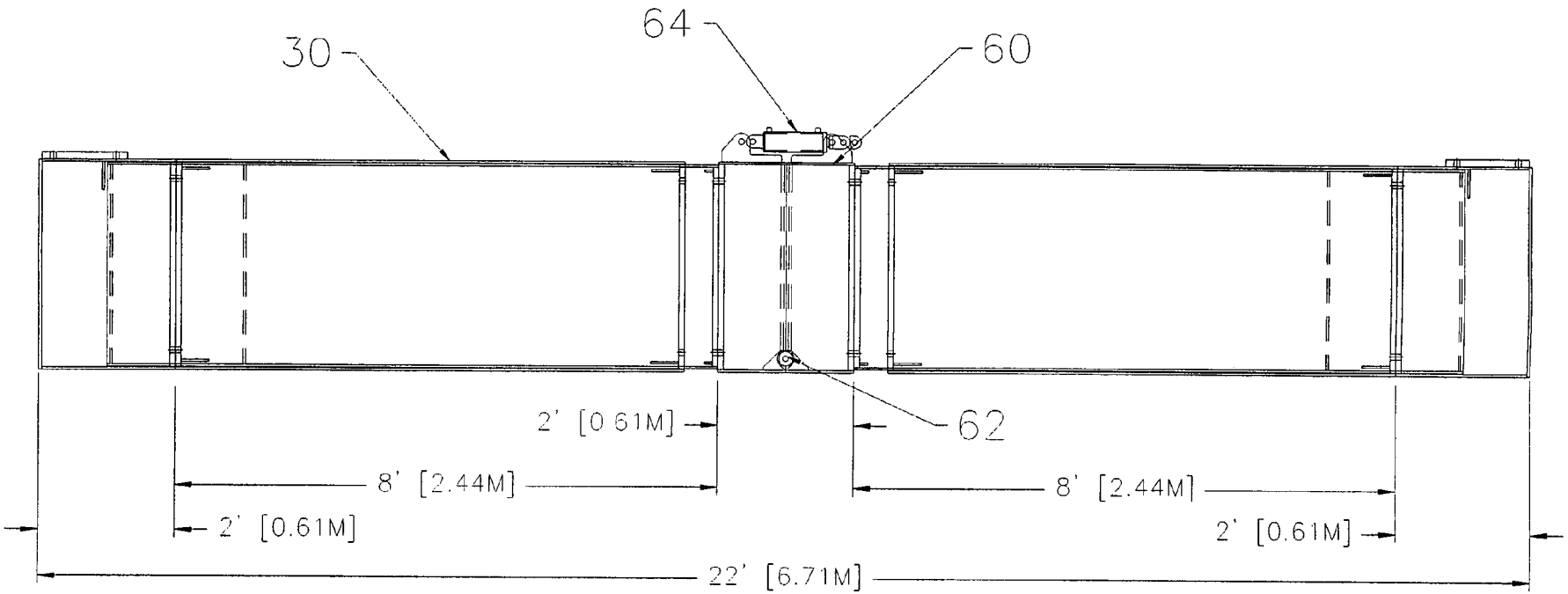

Referring to FIG. 7B, strike-off beam 30 has a central hinge member 60 having a lower hinge 62 and an upper hydraulic cylinder 64. The width of the strike-off beam 30 is here expanded to 22 feet. By expansion and contraction, cylinder 64 can apply an upwardly exposed berm centrally of the placed pavement. It will be understood that by the addition of various metal sections, beam width can be likewise expanded, for example to widths of 32 and 40 feet.

In the preferred embodiment, crawlers were illustrated. Other devices will work as well. For example, rails and flanged wheels can be used instead. Any transport scheme capable of preserving the level placement of concrete will suffice.

The above specification is exemplary of the main aspects of this invention. Much conventional detail has not been described. For example, the apparatus illustrates leveling gauges for leveling the roughly placed concrete relative to a guide wire system. This system is common to pavers used throughout the paving industry and is therefore not further explained here.

What is claimed is:

1. A placer/spreader for distributing a spreadable material to form a layer of the material on a substrate comprising:

a frame extending in a lateral direction over at least a portion of the substrate, the frame ending in spaced-apart lateral sides and spaced-apart ends between the sides which face in a travel direction of the placer/spreader, at least one of the lateral sides forming a lateral opening providing access to a space that is bounded by the frame;

a frame-propelling device secured to the frame proximate the lateral sides and capable of advancing the frame along the substrate in the travel direction;

a conveyor of a given length arranged in the space, extending in the lateral direction and having an intake end proximate the lateral opening and a discharge end located in the space;

a support structure movably mounting the conveyor on the frame so that the conveyor can be extended through the lateral opening for positioning the intake end at a spreadable material receiving location that is spaced in the lateral direction from the at least one lateral side of the frame for receiving the spreadable material, transporting the spreadable material to the space, and discharging the material from the discharge end onto the substrate beneath the frame, the support structure including a rail attached to the frame which stiffens the frame and is arranged between the lateral sides of the frame, and a belt support connected to the conveyor, engaging the rail and permitting reciprocating movements of the conveyor relative to the frame between a retracted conveyor position and the material receiving location of the intake end; and, a drive for reciprocating the conveyor between the retracted position and the receiving location.

2. The placer/spreader wherein the propelling devices according to claim 1 include crawlers.

3. The placer/spreader according to claim 1 wherein the drive includes a cable and winch.

4. The placer/spreader according to claim 1 wherein the drive means for moving the roll in/roll out conveyor in telescoping movement relative to the frame includes a hydraulic cylinder.

5. A placer/spreader according to claim 1 including a hinge for changing an angular inclination of the portion of the conveyor proximate the intake end to thereby change a relative vertical spacing between the substrate and the intake end.

6. A placer/spreader according to claim 1 including a cantilever support for the conveyor in a vicinity of the lateral opening for supporting a portion of the conveyor that extends laterally past the lateral opening as a cantilever.

7. A placer/spreader according to claim 1 including a strike-off plate affixed to and depending downwardly from the conveyor proximate its discharge end for spreading spreadable material in the lateral direction when the conveyor moves along the rail.

8. The placer/spreader according to claim 1 including a power unit for providing power to the frame propelling device, the drive and the conveyor, wherein the frame includes a cantilever support for the conveyor which supports a portion of the conveyor proximate the lateral opening as a cantilever, and wherein the power unit is attached to and carried by the frame at a location proximate the lateral side of the frame that is opposite the lateral opening.

9. The placer/spreader according to claim 1 wherein the frame includes first and second beams that extend between the lateral sides of the frame and that are spaced apart in the travel direction, and wherein the rail comprises first and second rails fixedly secured to an underside of the first and second beams.

10. The placer/spreader according to claim 1 wherein the spreadable material comprises ready-mixed concrete.

11. A placer/spreader for distributing a spreadable material to form a layer of the material on a substrate, the placer/spreader being movable in a transport direction along the substrate and adapted to receive the spreadable material at a location that is spaced from the layer in a lateral direction which is transverse to the travel direction, the placer/spreader comprising:

a laterally extending frame defined by first and second beams that are spaced apart in the transport direction, the frame defining a lateral opening at one of its lateral sides to provide access to a space beneath the beams;

a vehicular support coupled to the frame and adapted to support the frame on the substrate and move the frame in the transport direction along the substrate;

first and second rails affixed to and depending from the first and second beams which stiffen the beams against bending under a vertically acting load and are arranged along portions of the beams between the lateral sides of the frame;

a fixed-length, elongated belt conveyor having an intake end and a discharge end and movable along and supported by the rails so that the discharge end can be extended past the discharge opening for positioning at a location laterally spaced apart from the layer being formed on the substrate and the inner end is positioned beneath the first and second beams;

the frame including a cantilever support in a vicinity of the lateral opening which supports the belt conveyor so that a portion of the conveyor extending laterally past the lateral opening forms a cantilever terminating at the intake end of the conveyor, whereby the weight of the conveyor including spreadable material thereon is primarily carried on a portion of the frame proximate the lateral opening; and, a power unit for the placer/spreader carried by at least one of the beams and located in a vicinity of the other lateral side of the frame, whereby the weight of the power unit is primarily carried by a portion of the frame proximate the other lateral side to reduce bending stresses in a mid-portion of the frame.

12. The placer/spreader according to claim 11 including a spreader plow reciprocably movably supported by the frame for movement in lateral directions between the lateral sides of the frame and spreading the spreadable material in a lateral direction over a lateral extent of the layer being formed on the substrate, and a strike-off beam also carried by the frame which trails the spreader plow in the transport direction for shaping a top surface of the layer applied to the substrate.

13. The placer/spreader according to claim 11 wherein the conveyor is fully retractable into the space between the beams so that no part of the conveyor extends past the lateral sides of the frame, and wherein the strike-off beam is movably secured to the frame for movement between an operative position in which the strike-off beam is spaced apart from the frame and the spreader plow during use of the placer/spreader and a retracted position in which the strike-off beam is proximate the frame and the spreader plow when the placer/spreader is to be moved from one site to another.

14. The placer/spreader according to claim 11 wherein the propelling device comprises crawlers, and a mounting arrangement operatively coupling the crawlers to the frame for supporting the frame above the substrate and moving the frame in the transport direction, the mounting arrangement permitting pivotal movement of the crawlers from an operative position in which the crawlers extend in the transport direction and a shipping position in which the crawlers extend in the lateral direction and are disposed proximate the frame in the transport direction to thereby minimize a shipping width of the placer/spreader.

15. The placer/spreader according to claim 14 wherein the shipping width is slightly more than eight feet.

16. The placer/spreader according to claim 14 wherein the mounting arrangement includes jacking columns arranged proximate corners formed by the frame, the jacking columns being adapted to raise the frame sufficiently so that a flatbed truck can be backed under the raised frame and thereafter the frame can be lowered onto the flatbed truck for subsequent movement to another site.

17. A method for successively applying a layer of a spreadable material over substrates located at different sites which require transporting the placer/spreader on a truck from one site to the other site, the placer/spreader including a frame that extends in a lateral direction relative to a travel direction of the placer/spreader when the layer is applied to the substrate, the frame having lateral ends and a lateral opening at least one of the lateral ends and sides which are transverse to a travel direction of the frame along the substrate, a fixed-length belt conveyor having an intake end and a discharge end and movable relative to the frame in the lateral direction for extending the intake end laterally past the lateral opening and past the layer being applied to the substrate while the discharge end remains within a lateral extent of the frame, a drive for reciprocating the conveyor between an operative position in which the intake end is located laterally past the lateral opening and a shipment position in which the intake end is proximate the lateral opening, a strike-off beam located proximate a trailing side of the frame relative to the travel direction and movable relative to the frame between an operative position in which the strike-off beam is spaced from the frame in the travel direction and a shipment position in which the strike-off beam is proximate the frame, and jacking columns operatively coupled to the frame and mounted on crawlers which support the frame proximate the lateral ends thereof, the jacking columns and the crawlers being movable relative to the frame between an operative position in which the crawlers extend in the travel direction and are laterally spaced from the layer being applied to the substrate and a shipment position in which the crawlers and the jacking columns extend in the lateral direction and are located proximate the sides of the frame, the method comprising placing the placer/spreader at the first site with the crawlers, the jacking columns and the strike-off beam in their respective operative positions, extending a portion of the belt conveyor including the intake end past the lateral opening to the operative position, pouring the spreadable material onto the intake end of the conveyor and with the conveyor applying the spreadable material onto the substrate by dropping the spreadable material from the discharge end of the conveyor onto the substrate, with the crawlers, moving the placer/spreader in the travel direction, spreading the spreadable material dropped onto the substrate over a width of the layer, and with the strike-off beam leveling a top surface of the layer, thereafter, following completion of applying the layer to the substrate at the first site, retracting the conveyor to its shipment position so that its discharge end is proximate the lateral opening in the frame, moving the strike-off beam from its operative position to its shipment position proximate the frame, placing the frame onto the truck so that the sides of the frame extend parallel to the truck, moving the jacking columns and the crawlers into their shipment position in which the crawlers and the jacking columns are proximate the sides of the frame, thereafter transporting the placer/spreader with the truck to the second site, removing the placer/spreader from the truck by moving the crawlers and the jacking columns from their shipment positions to their operative positions, removing the truck from beneath the placer/spreader, moving the strike-off beam from its shipment position to its operative position, moving the conveyor from its shipment position to its operative position at which the intake end is laterally spaced from the frame and the layer to be applied to the substrate, and thereafter at the second site pouring the spreadable material onto the conveyor, discharging the spreadable material onto the substrate, and moving the placer/spreader with the crawlers along the substrate to form the layer of spreadable material at the second site.

18. A method according to claim 17 wherein placing the frame onto the truck comprises elevating the frame with the jacking columns relative to the crawlers, thereafter moving the truck beneath the frame, and with the jacking columns lowering the frame onto the truck.

19. A method according to claim 17 wherein an overall width of the placer/spreader when the strike-off beam, the jacking columns and the crawlers are in their shipment positions is only slightly more than eight feet for transporting the placer/spreader with the truck along public highways without exceeding a maximum permissible width for vehicles traveling on public highways.

20. A method according to claim 17 wherein the jacking columns and the crawlers are pivotable about upright axes, and wherein moving the jacking columns and the crawlers comprises pivoting the jacking columns and the crawlers about the upright axes.

* * * * *